United States Patent [19]

Staub et al.

[11] Patent Number: 4,474,231

[45] Date of Patent: Oct. 2, 1984

[54] MEANS FOR INCREASING THE CRITICAL HEAT FLUX OF AN IMMERSED SURFACE

[75] Inventors: Fred W. Staub, Schenectady; Michael H. McLaughlin, Scotia, both of N.Y.

[73] Assignee: General Electric Company, Schenectady, N.Y.

[21] Appl. No.: 290,269

[22] Filed: Aug. 5, 1981

[51] Int. Cl.[3] ..... F28F 13/18

[52] U.S. Cl. ..... 165/133; 62/64; 62/373; 165/DIG. 11

[58] Field of Search ..... 165/133, DIG. 11; 62/527, 64, 373

[56] References Cited

U.S. PATENT DOCUMENTS

| | | | |
|---|---|---|---|
| 3,207,209 | 9/1965 | Hummel | 165/1 |
| 3,301,314 | 1/1967 | Gaertner | 165/1 |
| 3,684,007 | 8/1972 | Ragi | 165/133 |
| 4,050,507 | 9/1977 | Moran | 165/1 |
| 4,223,723 | 9/1980 | Hilal | 165/133 |
| 4,380,907 | 4/1983 | Barnes | 165/133 X |
| 4,434,842 | 3/1984 | Gregory | 165/133 |

OTHER PUBLICATIONS

J. H. Lienhard, V. K. Dhir, D. M. Riherd, "Peak Pool Boiling Heat-Flux Measurements on Finite Horizontal Flat Plates", Jrnl. of Heat Transfer, Nov. 1973, pp. 477–482.

J. C. Corman, M. H. McLaughlin, "Boiling Augmentation with Structured Surfaces", ASHRAE Trans. 82(1), 1976, pp. 906–918.

J. H. Lienhard, V. K. Dhir, "Hydrodynamic Prediction of Peak Pool-Boiling Heat Fluxes from Finite Bodies", Trans. of ASME, May, 1973, pp. 152–158.

*Primary Examiner*—Sheldon J. Richter

*Attorney, Agent, or Firm*—Paul J. Checkovich; James C. Davis, Jr.; Bernard J. Lacomis

[57] ABSTRACT

Structured boiling surfaces for increasing the critical heat flux of immersed surfaces are disclosed. The structures comprise holes or cavities in the boiling surface which constrain vapor jets to be less than the natural spacing thereof, which satisfy the vapor-liquid flooding criteria and which supply added surface area. A configuration having an arcuate surface in order to facilitate vapor removal therefrom when operated in a downwardly facing direction is disclosed.

8 Claims, 7 Drawing Figures

MEANS FOR INCREASING THE CRITICAL HEAT FLUX OF AN IMMERSED SURFACE

BACKGROUND OF THE INVENTION

The invention relates to the structure of an immersed surface. More particularly, it relates to a means for increasing the critical heat flux of an immersed surface. The invention is not directed toward increasing the heat transfer rate or increasing the surface heat transfer coefficient except that such increases may be incidental to and interdependent with an increase in the critical heat flux.

In many immersion cooling applications, i.e. those in which the component to be cooled is immersed in a cooling medium, the thermal rating of the component being cooled is limited by the critical heat flux. For example, the maximum power rating of power semiconductor modules is limited by the critical heat flux in immersion cooling. The critical heat flux may be defined as the maximum total heat per unit area capable of being transferred from a given surface without an excessive temperature rise.

It has been shown that when vapor jets in the cooling liquid at high heat flux are spaced closer together than their natural spacing or wavelength by the use of baffles above the heating surfaces then an increase in the critical heat flux is obtained. However, in a counter-current liquid vapor flow the maximum vapor velocity in the vapor jets is limited by flooding, which is the point at which the liquid phase can no longer flow to the surface of the object to be cooled because of the quantity of vapor emanating therefrom. It is desired to increase the critical heat flux capability of pool or immersed boiling surfaces while not losing the advantage of higher thermal conductance in a more gradual transition to film boiling thereby delaying the occurrence of flooding.

While the use of finned surfaces can lower the temperature rise with nucleate boiling, such finned surfaces have limited effect on the critical heat flux unless they are appropriately designed. For instance, if the fin is too long, the temperature drop along the fin may be too large. This excessive temperature drop may create a situation where there is nucleate boiling at or near the tip of the fin but where there is a film boiling condition at the base of the fin. The slot surface area between fins also must be limited since if there is too much surface area, too much vapor will be generated in the slots and local flooding will then be reached at a lower heat flux.

SUMMARY OF THE INVENTION

It is an object of the present invention to increase the critical heat flux of an immersed boiling surface to provide for maximum heat transfer at a minimum temperature rise.

It is another object of the present invention to improve the power rating of semiconductor modules and other equipment to be cooled by immersion cooling.

It is another object of the present invention to provide a structured boiling surface which increases the critical heat flux capability of an immersion boiling surface while not losing the advantage of higher thermal conductance and a more gradual transition to film boiling.

It is another object of the present invention that the structured boiling surface minimize the effect of local flooding.

It is a further object of the present invention to provide a structured boiling surface for increasing the critical heat flux which may be efficiently operated with a downwardly facing orientation.

In accordance with the present invention, an immersible structured boiling surface is disclosed. Configurations having an array of holes or cavities positioned in the surface of the object to be immersed and thereby cooled are shown. The cross sectional area of a hole or cavity at the surface of the object satisfies the liquid-vapor flooding criteria. The center to center dimension between adjacent holes or cavities is less than the natural spacing or wavelength of the vapor jets from the surface. A conically shaped hole or cavity is preferred when the fin conduction temperature drop is large. A configuration is disclosed for a downwardly facing boiling surface.

DETAILED DESCRIPTION

This invention relates to the structure of an immersed boiling surface. More particularly, it relates to a means for increasing the critical heat flux of an immersed boiling surface. The invention is not directed toward increasing the heat transfer rate or increasing the surface heat transfer coefficient except as such increases may be incidental to and interdependent with an increase in the critical heat flux.

Figure 1:
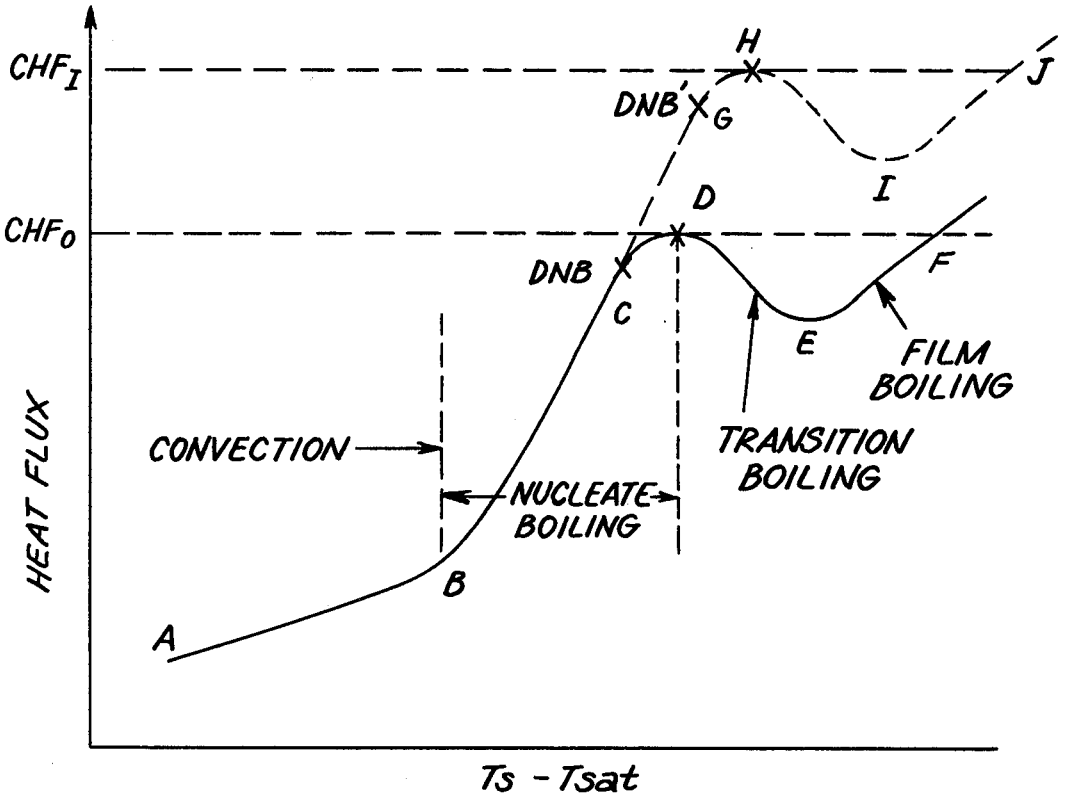
FIG. 1 is a graph showing a typical boiling curve.

Referring to FIG. 1, a graph showing the heat transfer from an immersed surface to a pool of liquid is shown. The portion of the curve from A to B represents heat transfer by natural convection. The portion of the curve from B to D represents nucleate boiling wherein the point D is at the critical heat flux. Nucleate boiling is represented by the condition wherein bubbles form at active nuclei on the heating surface, detach and rise to the surface of the liquid. The portion of the curve from D to E represents a transitional boiling state wherein the liquid approaches film boiling. Point E represents the point at which a complete vapor film has formed on the surface and is also the point of minimum heat flux. The section of the curve from E to F represents established film boiling.

Nucleate boiling is a phenomenon which takes place as the energy input in the form of heat from a surface to a surrounding liquid is increased. A temperature is reached at which fluid vapor bubbles will form on the heat surface. These bubbles form at sites called nuclei. Initially, if the liquid temperature is below the saturation temperature of the liquid, the vapor bubbles will collapse. As the liquid temperature and energy inputs are increased, bubbles will become more numerous and they will coalesce to form a trail or vapor jet from the nuclei to the surface of the liquid. The natural spacing or wavelength of these vapor jets is determined by fluid flow stability criteria at the liquid-vapor interface. At a heat flux designated as point C, the liquid feed to the surface becomes limited by flooding and there is a decrease in the heat transfer rate. This point is known as a departure from nucleate boiling (DNB). If the heat flux is raised further to point D, the point of critical heat flux ($CHF_o$) will be reached. An insulating film of vapor will begin to form on the heat surface at this point. The region is an unstable one and under certain conditions the temperature difference will change rapidly to point F. For any practical cooling system to be used with electronic equipment, the operating point should be at or below point C.

The departure from nucleate boiling and subsequent film formation is caused by a phenomenon called flooding. In the region of nucleate boiling, as the heat flux is increased, the formation of vapor is likewise increased. However, a point C is reached where the outward flow of vapor becomes great enough to prevent the flow of liquid or the flooding of to the surface. When no more liquid can reach the surface, a vapor pocket or film is formed thereon. This is the point of critical heat flux. In order to transfer more heat from the surface to be cooled to the fluid, it is desirable to increase the critical heat flux. One of the objects of this invention is to effect this increase in critical heat flux. The dashed curve on the graph of FIG. 1 is representative of a system wherein the critical heat flux ($CHF_I$) has been increased to point H and the departure from nucleate boiling has been increased to point G. As shown on the graph these increases have been effected without necessarily changing the slope of the heat flux vs. temperature difference line.

Figure 2A:
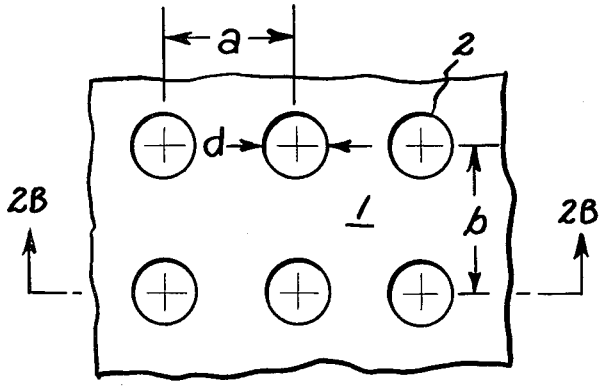
FIGS. 2A, 2B, 3A and 3B are structured boiling surfaces made in accordance with the present invention.
Figure 2B:
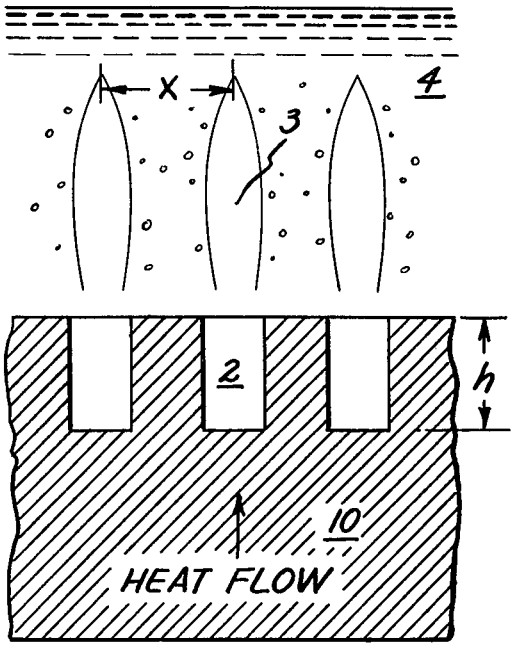

Referring to FIGS. 2A and 2B, a structure 10 made in accordance with the present invention is shown. FIG. 2A is a plan view of the surface 1 and FIG. 2B is a sectional view looking in the direction of the arrows labeled 2B in FIG. 2A.

The structure 10 as shown in FIG. 2A comprises a surface adapted to be immersed in a liquid 4 and holes or cavities 2 therein. The liquid 4 with vapor jets 3 therein is shown in FIG. 2B. The holes or cavities 2 preferably have a cylindrical contour.

For ease of manufacture and discussion the holes or cavities preferably arranged in a predetermined array. However, this invention is not limited to such an array or to the method of obtaining a surface having holes or cavities and any arrangement of the holes or cavities 2 in a surface 1 which results in a vapor jet spacing x less than the natural spacing or wavelength thereof is intended to be within the scope of this invention.

An array wherein the spacings a and b, not necessarily equal, from the center of a hole or cavity to the center of an adjacent hole or cavity are less than the natural spacing or wavelength of vapor jets from a surface having no holes or cavities whereby the vapor jet spacing x is forced to be less than the natural spacing thereof is shown in FIG. 2B. The natural spacing of vapor jets is determined by fluid flow stability criteria at the vapor-liquid interface. The centers of the holes or cavities may be located at the intersection of a row and column defining lines of an orthogonal matrix. The cross-sectional area of the hole or cavity at the surface 1 as shown in FIG. 2A must statisfy the vapor-liquid flooding criteria in order that sufficient liquid will flow to the surface. For a cylindrical hole or cavity this cross-sectional area would be $\pi(d/2)^2$.

By way of example and not by way of limitation, a structured surface comprising copper and made in accordance with the invention as shown in FIGS. 2A and 2B may have about the following dimensions: a=0.125 inches; b=0.125 inches; d=0.065 inches; h=0.125 inches, wherein the liquid is refrigerant—113 at 40° C. saturation.

Figure 3A:
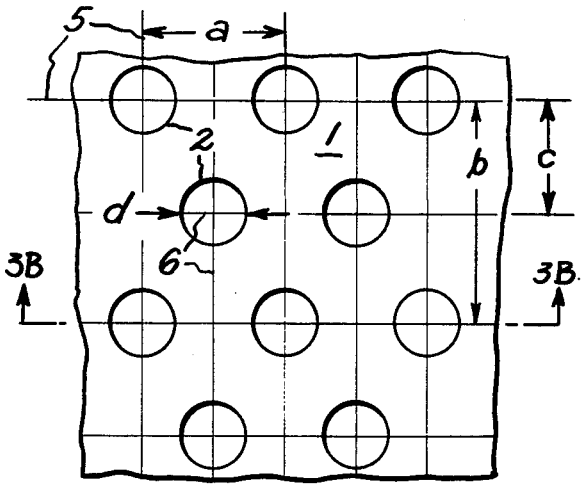
Figure 3B:
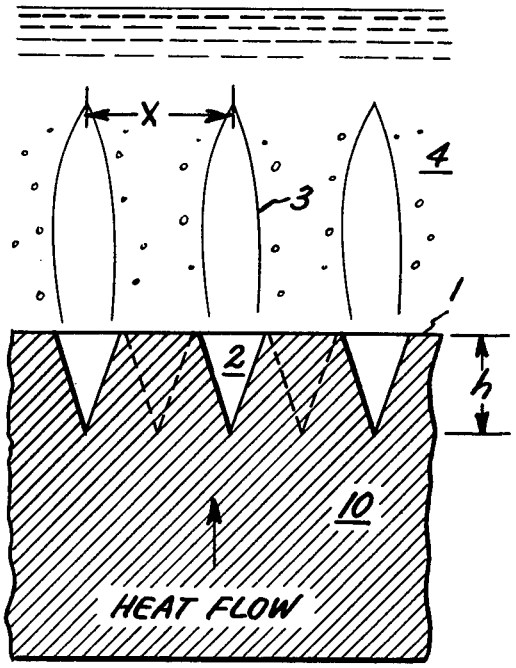

Referring to FIGS. 3A and 3B another structure 10 made in accordance with the present invention is shown. FIG. 3A is a plan view of the surface 1 and FIG. 3B is a sectional view looking in the direction of the arrows labeled 3B in FIG. 3A.

The structure 10 as shown in FIG. 3A comprises a surface 1 adapted to be immersed in a liquid 4 and holes or cavities 2 therein. The liquid 4 with vapor jets 3 therein is shown in FIG. 3B. The holes or cavities 2 preferably have a substantially right circular conical contour with the base thereof in the plan of the surface 1.

For ease of manufacture and discussion the holes or cavities are preferably arranged in a predetermined array. However, this invention is not limited to such an array or the the method of obtaining a surface having holes or cavities and any arrangement of the holes or cavities 2 in the surface 1 which results in a vapor jet spacing x less than the natural spacing or wavelength thereof is intended to be within the scope of this invention. The spacings a, b, and c, not necessarily equal, from the center of a hole or cavity to the center of an adjacent hole or cavity are less than the natural spacing or wavelength of vapor jets from a surface 1 having no holes or cavities as hereinbefore described.

The centers of the holes or cavities may be located in an array defined by superimposed first 5 and second 6 orthogonal matrices having the row defining lines of the first matrix equally spaced, the column defining lines of the first matrix equally spaced, the row defining lines of the second matrix equally spaced and the column defining lines of the second matrix equally spaced wherein the center of the holes or cavities of the first matrix are located at the intersection of the row and column defining lines 5 thereof and wherein the center of the holes or cavities of the second matrix are located at the intersection of the row and column defining lines 6 thereof. The matrices are superimposed such that their row and column lines are respectfully parallel, the row lines of the second matrix are positioned between adjacent row lines of the first matrix, the column lines of the second matrix are positioned between adjacent column lines of the first matrix and the bases of the holes or cavities do not overlap.

By way of example and not by way of limitation, a structure comprising copper and made in accordance with the invention as shown in FIG. 3 may have about the following dimensions: a=0.125 inches; b=0.44 inches; c=0.22 inches; d=0.065 inches; h=0.125 inches, wherein the liquid is refrigerant—113 at 40° C. saturation.

The configurations of the present invention shown in FIGS. 2A, 2B, 3A and 3B are particularly useful for increasing the critical heat flux capability and thereby increasing the power rating of electronic equipment. At present, for example, the maximum rating of power semiconductor modules is limited by the critical heat flux in immersion cooling. By providing the modules with structures for cooling made in accordance with the present invention, the maximum rating thereof may be increased.

Figure 4A:
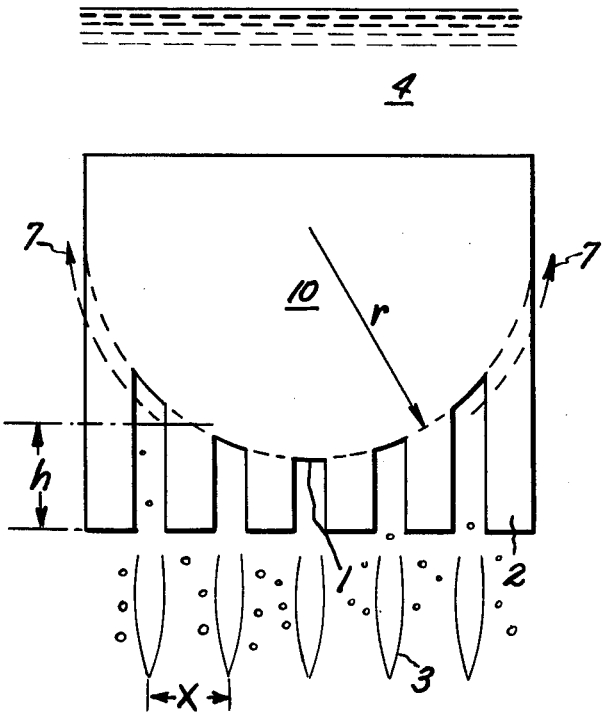
FIGS. 4A and 4B show a structured boiling surface made in accordance with the present invention wherein the surface is adapted for downwardly facing operation.
Figure 4B:
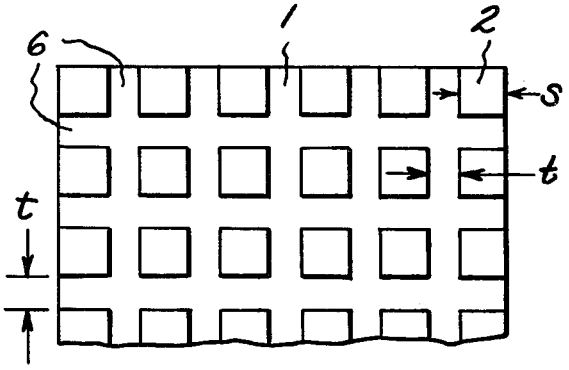

Referring to FIGS. 4A and 4B, a structure 10 made in accordance with the present invention is shown. FIG. 4A is a plan elevational view of the structure 10 and FIG. 4B is a plan view looking onto the surface 1.

The structure 10 as shown in FIG. 4A comprises an arcuate surface 1 having a plurality of fins 2 protruding therefrom and in heat flow communication therewith.

The fins 2 have slots 6 positioned therebetween. The shape of the fins is not critical as long as the vapor jet 3 spacing x in the liquid 4 is less than the natural wavelength or spacing of vapor jets from a surface 1 having no fins as hereinbefore described and the total slot cross-sectional area between fins satisfies the vapor-liquid flooding criteria.

The structure 10 is adapted to be operated in a downwardly facing direction. In other words, the surface 1 is adapted to operate under conditions where the buoyant forces of the liquid 4 on vapor from the surface 1 will tend to force the vapor against the surface. Because of the arcuate contour of the surface, 1, vapor from the surface 1 which is forced against it by the buoyant forces of the liquid 4 will tend migrate in the slots 6 toward a higher elevational point and eventually reach the border of the structure 10 at a vapor vent 7. The augumented removal of vapor from the surface 1 increases the temperature at which film boiling will occur and thereby increases the critical heat flux.

By way of example and not by way of limitation, a structure 10 comprising copper and made in accordance with the invention as shown in FIG. 4 may have about the following dimensions: s=0.10 inches; t=0.04 inches; r=3 inches; average h=0.25 inches, wherein the liquid is refrigerant—113 at 40° C. saturation, the fins are square, the slots 6 form an orthogonal matrix and the surface 1 has a longitudinal axis parallel to one of the orthogonal axes of the slots. In general for this configuration, the total slot cross-sectional area must satisfy the vapor-liquid flooding criteria and the dimension (s+t) must be less than the natural wavelength or spacing of vapor jets from the surface as hereinbefore described.

Where the conduction temperature drop per unit length, which is a function of the nature of the material of the structure 10, is large, the configuration as shown in FIGS. 3A and 3B is preferred.

Although the preferred embodiments of the present invention have been described and illustrated, other configurations and modifications will become apparent from the foregoing to one skilled in the art. It is intended that the scope of this invention is limited only by the appended claims.

What we claim as new and desired to secure Letters Patent of the United States is:

1. A structure for transferring heat to a liquid and for increasing the critical heat flux thereto comprising:
   - a surface of said structure adapted to be submersed in said liquid;
   - said surface having a plurality of cavities terminating at said surface wherein each of said cavities extends only partially through said structure;
   - wherein the cross-sectional area of each of said cavities at said surface satisfies the vapor-liquid flooding criteria of said liquid; and
   - further wherein the distance from the center of each said plurality of cavities to the center of each respective adjacent cavity is less than the natural wavelength of vapor jets from a planar surface of said structure, said planar surface having no cavities terminating at said planar surface, whereby generation of film boiling at said surface of said structure is avoided.

2. The structure as in claim 1 wherein said cavities have a substantially cylindrical contour having the longitudinal axis perpendicular to said surface.

3. The structure as in claim 1 wherein said cavities have a substantially right circular conical contour with the base thereof in the plane of said surface.

4. The structure as in claim 2 or 3 wherein said cavities are positioned in a predetermined array.

5. The structure as in claim 2 wherein said cavities are positioned such that the centers thereof are at the intersection of row defining lines and column defining lines of an orthogonal array.

6. The structure as in claim 3 wherein said cavities are positioned in an array formed by the superposition of:
   - (a) a first orthogonal matrix wherein the center of the cavities are located at the intersections of row defining lines and column defining lines;
   - (b) a second orthogonal matrix wherein the center of said cavities are located at the intersections of row defining lines and column defining lines;
   - (c) further having said row defining lines of said first matrix equally spaced, said column defining lines of said first matrix equally spaced, said row defining lines of said second matrix equally spaced and said column defining lines of said second matrix equally spaced;
   - (d) wherein said first and second matrices are superimposed such that their row and column lines are respectfully parallel; and
   - (e) further having said row lines of said second matrix positioned between adjacent row lines of said first matrix and said column lines of said second matrix positioned between adjacent column lines of said first matrix such that the bases of said orifices do not overlap.

7. A structure for transferring heat to a liquid and for increasing the critical heat flux thereto, comprising:
   - (a) an arcuate surface of said structure adapted to be submersed in said liquid;
   - (b) a plurality of orthogonally intersecting slots on said surface to form a plurality of fins thereon wherein each of said slots extends only partially through said structure;
   - (c) wherein the width of said fins plus the width of a slot adjacent said fins is less than the natural wavelength of vapor jets from a planar surface of said structure, said planar surface having no slots terminating at said planar surface;
   - (d) wherein the cross sectional area of said slots at said arcuate surface satisfies the vapor-liquid flooding criteria or said liquid; and
   - (e) wherein the bases of said slots are positioned along said arcuate surface.

8. The structure as in claim 7 wherein said aracate surface has a longitudinal axis parallel to at least one of the orthogonal axes of said slots.

* * * * *